US010458145B2

(12) United States Patent
Cantwell et al.

(10) Patent No.: US 10,458,145 B2
(45) Date of Patent: Oct. 29, 2019

(54) LIGHTED SHELTER FRAME CONNECTOR

(71) Applicants: Robert R. Cantwell, Leslie, MO (US); Jerry L. Tombleson, Jr., Brookfield, MO (US)

(72) Inventors: Robert R. Cantwell, Leslie, MO (US); Jerry L. Tombleson, Jr., Brookfield, MO (US)

(73) Assignee: The Associates Group, LLC, Leslie, MO (US)

( * ) Notice: Subject to any disclaimer, the term of this patent is extended or adjusted under 35 U.S.C. 154(b) by 41 days.

(21) Appl. No.: 15/713,548

(22) Filed: Sep. 22, 2017

(65) Prior Publication Data

US 2018/0100325 A1 Apr. 12, 2018

Related U.S. Application Data

(60) Provisional application No. 62/398,280, filed on Sep. 22, 2016, provisional application No. 62/440,567, filed on Dec. 30, 2016.

(30) Foreign Application Priority Data

Nov. 16, 2016 (CN) ..... 2016 2 1245822 U

(51) Int. Cl.
*E04H 15/10* (2006.01)
*A45B 3/02* (2006.01)

(52) U.S. Cl.
CPC ..... *E04H 15/10* (2013.01); *A45B 3/02* (2013.01); *A45B 2200/1018* (2013.01); *A45B 2200/1027* (2013.01)

(58) Field of Classification Search
CPC .... E04F 15/10; A45B 3/02; A45B 2200/1018; A45B 2200/1027

(Continued)

(56) References Cited

U.S. PATENT DOCUMENTS 593,841 A * 11/1897 Greenfield ..... H02G 3/085 220/3.2
1,742,438 A * 1/1930 D Olier, Jr. ..... F21V 21/03 248/343

(Continued)

FOREIGN PATENT DOCUMENTS

WO WO-2017051253 A1 * 3/2017 ..... E04H 15/50

OTHER PUBLICATIONS

World Intellectual Property Organization, International Publication No. WO 2015/183926 A1, Big Agnes Inc., published Dec. 3, 2015.

(Continued)

*Primary Examiner* — Robert Canfield
(74) *Attorney, Agent, or Firm* — David E. Crawford; Crawford IP Law

(57) ABSTRACT

A frame joint connects a plurality of elongate frame members adapted to support a flexible shelter skin. The frame joint includes a first housing having an interior and frame connectors. Each frame connector is adapted to releasably connect an elongate frame member to the first housing. The frame joint includes an electrical source mounted in the interior of the first housing. A light emitting element mounted on the first housing and connected to the electrical source emits light to illuminate an interior of the shelter. The light emitting element is positioned on the first housing to direct light toward the interior of the shelter when the joint is connected to the elongate frame members and the frame members are supporting the flexible shelter skin. The frame joint includes a switch operatively connected to the electrical source and the light emitting element for selectively energizing the light emitting element.

29 Claims, 17 Drawing Sheets

(58) Field of Classification Search
USPC ..... 135/91, 909, 910; 362/145, 148, 367; 52/28; 446/91, 227, 485; 174/60, 64
See application file for complete search history.

(56) References Cited

U.S. PATENT DOCUMENTS 3,624,269 A * 11/1971 Latta ..... E04H 12/003 174/45 R
3,970,096 A 7/1976 Nicolai
4,408,260 A * 10/1983 Miedel ..... E04H 15/10 135/114
4,712,165 A * 12/1987 Cetrone ..... F21S 2/00 362/147
4,915,666 A * 4/1990 Maleyko ..... A63B 19/00 446/242
4,936,478 A * 6/1990 Bozdeck ..... G09F 13/04 174/657
4,959,506 A * 9/1990 Petty ..... H02G 3/0616 174/669
5,145,443 A * 9/1992 Vaisnys ..... A63B 19/00 446/242
6,305,822 B1 10/2001 Lin
6,702,643 B1 * 3/2004 Drosendahl ..... A63H 33/006 446/175
6,773,140 B2 8/2004 Lee
6,840,657 B2 * 1/2005 Tung ..... A45B 3/04 135/910
7,431,470 B2 * 10/2008 Coleiro ..... A45B 3/04 362/102
7,455,427 B1 11/2008 Freeman
7,726,852 B2 * 6/2010 Sanoner ..... F21V 21/096 135/16
7,731,558 B2 * 6/2010 Capriola ..... A63H 33/042 273/120 A
7,856,996 B2 * 12/2010 Ma ..... A45B 3/02 135/16
D633,233 S 2/2011 DeBrunner
2003/0137831 A1 * 7/2003 Lin ..... F21S 8/022 362/183
2003/0179576 A1 * 9/2003 Huang ..... E04H 15/32 362/253
2004/0184261 A1 * 9/2004 Lin ..... A45B 3/04 362/102
2005/0121063 A1 * 6/2005 Chang ..... A45B 3/04 135/15.1
2006/0084357 A1 * 4/2006 Rosen ..... A63H 33/107 446/91
2006/0102217 A1 5/2006 Hsiang
2006/0266398 A1 * 11/2006 Wu ..... A45B 3/04 135/91
2006/0272686 A1 * 12/2006 Tung ..... A45B 3/04 135/16
2006/0272692 A1 * 12/2006 Wu ..... E04H 15/10 135/91
2007/0056617 A1 * 3/2007 Li ..... A45B 3/04 135/91
2007/0151588 A1 * 7/2007 Yul ..... E04H 15/10 135/91
2008/0000513 A1 * 1/2008 Yul ..... E04H 15/10 136/245
2008/0105287 A1 * 5/2008 Huali ..... A45B 3/04 135/16
2008/0173341 A1 * 7/2008 Falin ..... E04F 10/00 135/91
2010/0029170 A1 * 2/2010 Hall ..... A47D 13/06 446/227
2012/0304901 A1 12/2012 Volin
2013/0244533 A1 * 9/2013 Elson ..... A63H 33/006 446/227
2014/0096802 A1 * 4/2014 Volin ..... A45B 25/143 135/16
2014/0273711 A1 * 9/2014 Capriola ..... A63H 33/042 446/91
2014/0366922 A1 * 12/2014 King ..... E04H 15/58 135/96
2015/0034137 A1 2/2015 Tanaeim
2017/0292285 A1 * 10/2017 Jin ..... F21V 23/04

OTHER PUBLICATIONS

World Intellectual Property Organization, International Publication No. WO 2012/088973 A1, Campvalley Xiamen Co. Ltd., published Jul. 5, 2012.

* cited by examiner

LIGHTED SHELTER FRAME CONNECTOR

CROSS REFERENCE

This Application claims priority to U.S. Provisional Application No. 62/398,280 entitled, "LIGHT FRAME HUB" filed Sep. 22, 2016, U.S. Provisional Application No. 62/440,567 entitled, "SOLAR LIGHT FRAME HUB" filed Dec. 30, 2016, and Chinese Utility Model No. 206360460U entitled, "LITE FRAME HUB" filed Nov. 16, 2016, which are incorporated by reference in their entireties.

BACKGROUND

The present invention relates to shelter frames, and more particularly, to a shelter frame connector having lights for illuminating an interior of the shelter.

Temporary shelters such as tents, canopies, and awnings are used to protect people from weather conditions outside. After dark, lighting is frequently desirable to illuminate the sheltered space. In the past, open flames and lanterns have been used to illuminate tents, sometimes with tragic results. Alternatively, flashlights and battery-powered lanterns have been used. Although these devices work well in general, they have certain drawbacks. Because these lights are separate from the tent structure, they may be lost. For optimal illumination, means for suspending the lights in the shelter must be devised. Conventional light sources typically do not have such suspending means, and suspending heavy lights from shelter fabric or tent poles can damage equipment. Further, many existing light sources use battery-powered incandescent bulbs that consume significant power and result in considerable waste because spent batteries must be disposed of if the batteries are not rechargeable. Thus, there is a need for an improved lighting system for camping tents, backyard structures, and other structures. Several lighting system configurations are described below that provide simple solutions that integrate with the frames of tents and other fabric shelters.

SUMMARY

In one aspect described below, a frame joint connects a plurality of elongate frame members adapted to support a flexible shelter skin. The frame joint comprises a first housing having an interior and a plurality of frame connectors. Each frame connector is adapted to releasably connect the first housing to an elongate frame member. The frame joint includes an electrical source mounted in the interior of the first housing. A light emitting element mounted on the first housing and connected to the electrical source emits light to illuminate an interior of the shelter. The light emitting element is positioned on the first housing to direct light toward the interior of the shelter when the joint is connected to the elongate frame members and the frame members are supporting the flexible shelter skin. The frame joint includes a switch operatively connected to the electrical source and the light emitting element for selectively energizing the light emitting element.

In another aspect, a frame joint for connecting a plurality of elongate frame members adapted to support a flexible shelter skin is described. The frame joint comprises a housing having an interior and at least two frame connectors. A first frame connector connects a first elongate frame member to the housing and a second elongate frame member to the housing, so the second elongate frame member extends at an oblique angle relative to the first elongate frame member. Further, the frame joint includes a battery adapted for storing an electrical charge mounted in the interior of the housing and a light emitting element mounted on the housing and connected to the battery for emitting light to illuminate an interior of the shelter. The light emitting element is positioned on the housing to direct light toward the interior of the shelter when the housing is connected to the first and second elongate frame members. A switch is operatively connected between the battery and the light emitting element for selectively energizing the light emitting element.

In still another aspect, a frame joint connects a plurality of elongate frame members adapted to support a flexible shelter skin. The frame joint comprises a first housing having an interior and a plurality of frame connectors. Each frame connector is adapted for releasably connecting an elongate frame member to the housing. The frame joint also includes a battery adapted for storing an electrical charge mounted in the interior of the housing and a light emitting element mounted on the first housing and connected to the electrical source for emitting light to illuminate an interior of the shelter. The light emitting element is positioned on the first housing to direct light toward the interior of the shelter when the joint is connected to the elongate frame members and the plurality of elongate frame members are supporting the flexible shelter skin. A switch operatively connects the electrical source and the light emitting element for selectively energizing the light emitting element.

Other aspects will be apparent in view of the following description and claims.

BRIEF DESCRIPTION OF THE DRAWINGS

Corresponding reference characters indicate corresponding parts throughout the drawings.

DETAILED DESCRIPTION OF THE DRAWINGS

Figure 1:
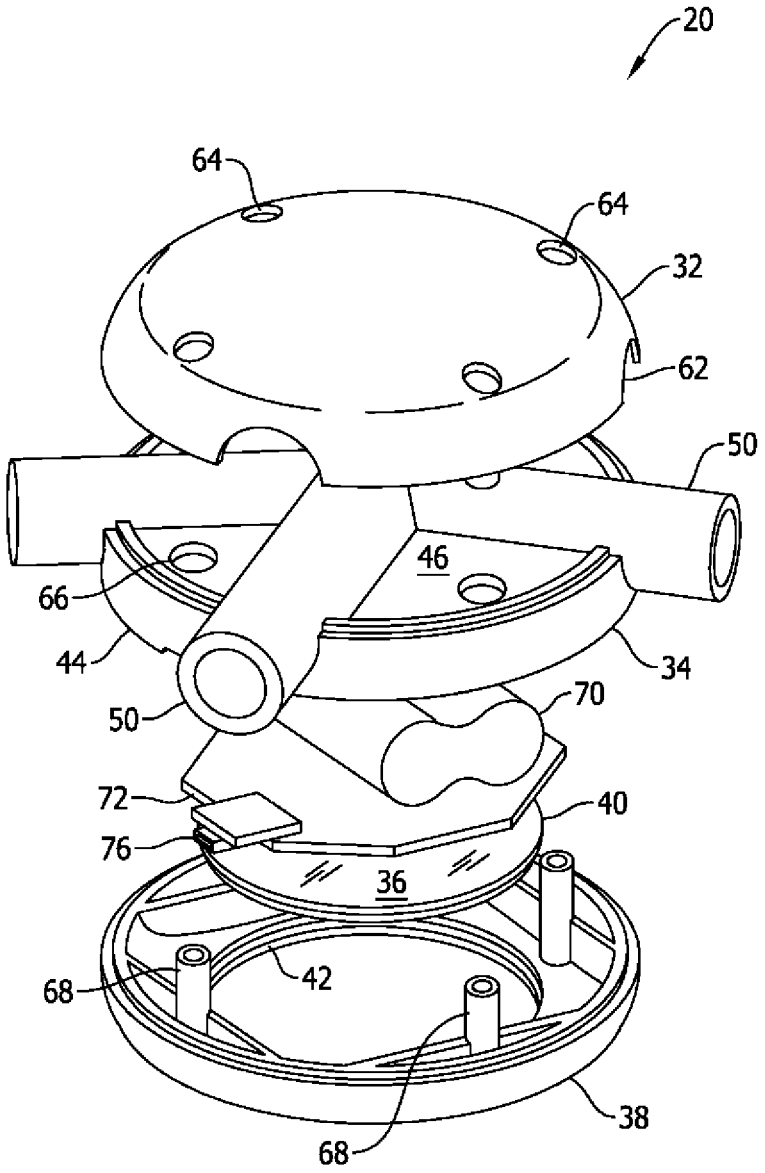
FIG. 1 is a separated top down perspective of a hub of a first configuration.
Figure 2:
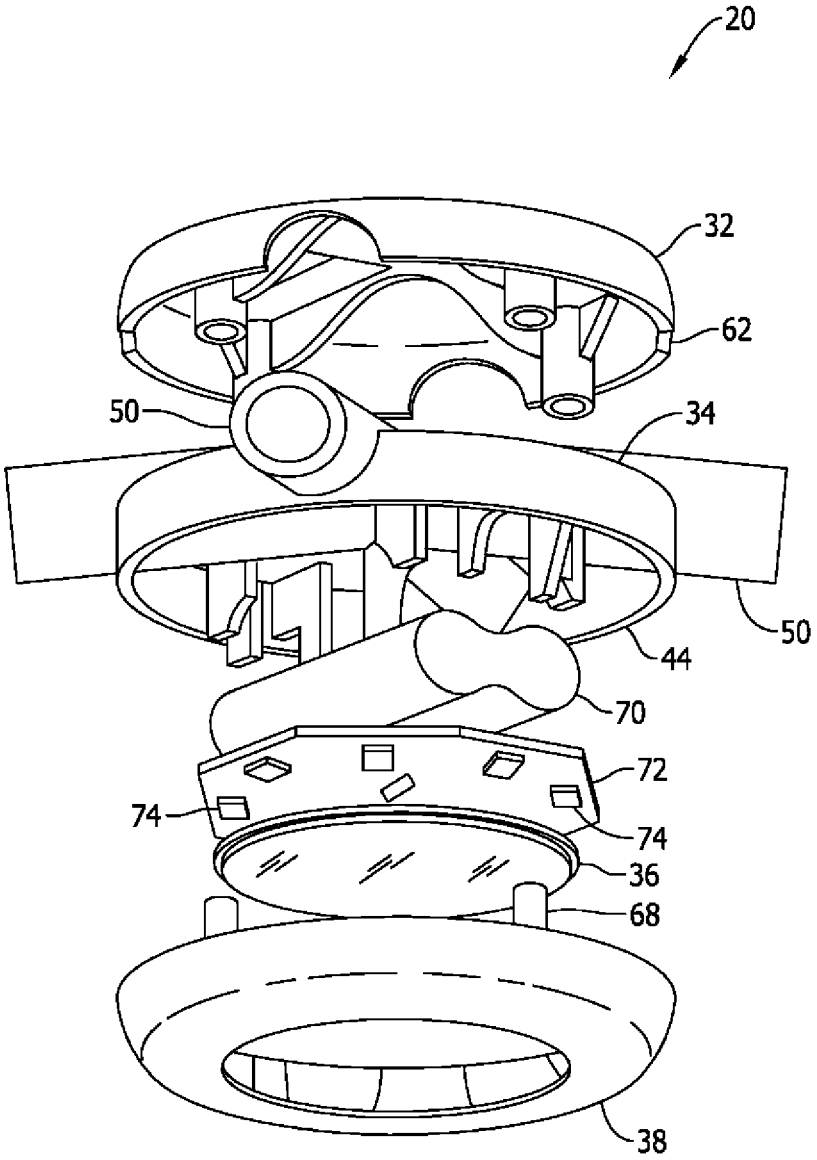
FIG. 2 is a separated bottom up perspective of the hub of FIG. 1.
Figure 3:
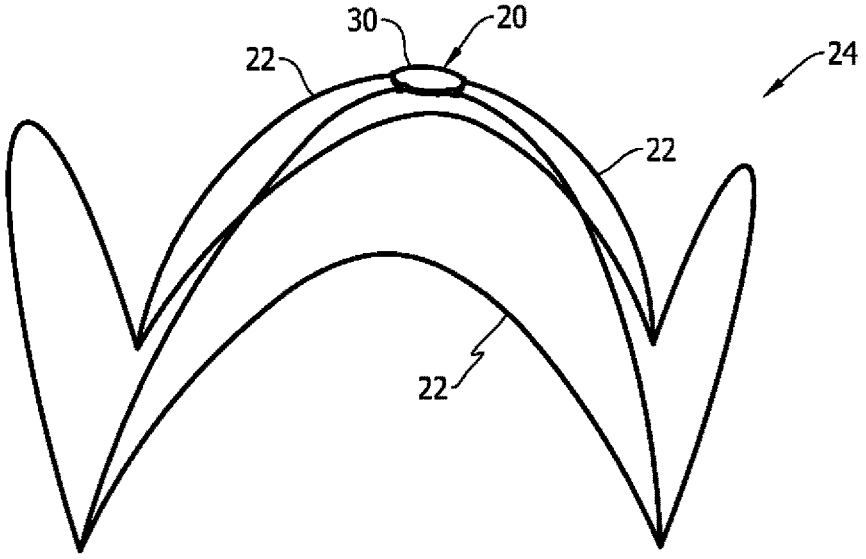
FIG. 3 is a perspective of a tent frame assembled with the hub of FIG. 1.
Figure 4:
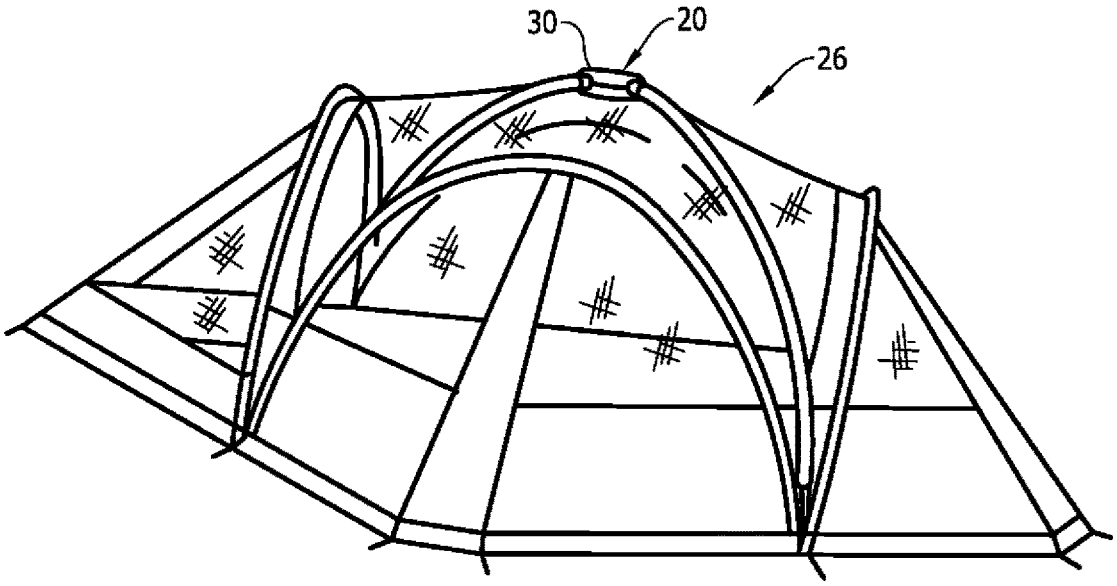
FIG. 4 is a perspective of a tent assembled with the hub of FIG. 1.
Figure 5:
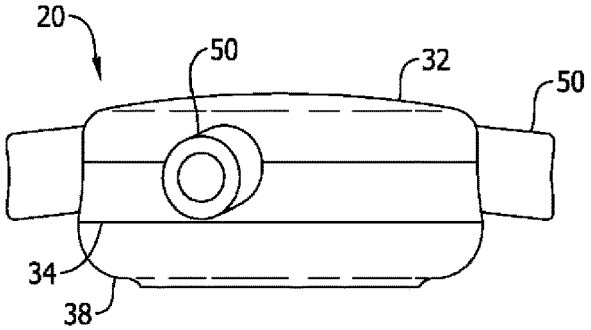
FIG. 5 is a left side elevation of the hub of FIG. 1.
Figure 6:
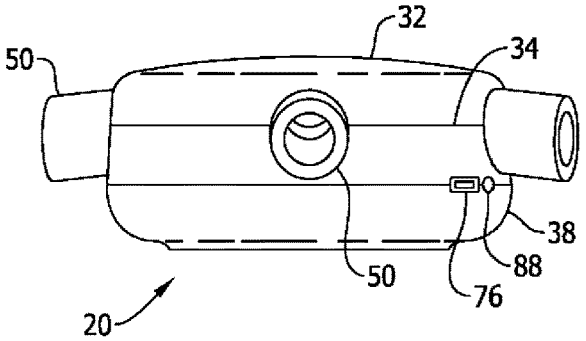
FIG. 6 is a front elevation of the hub of FIG. 1.
Figure 7:
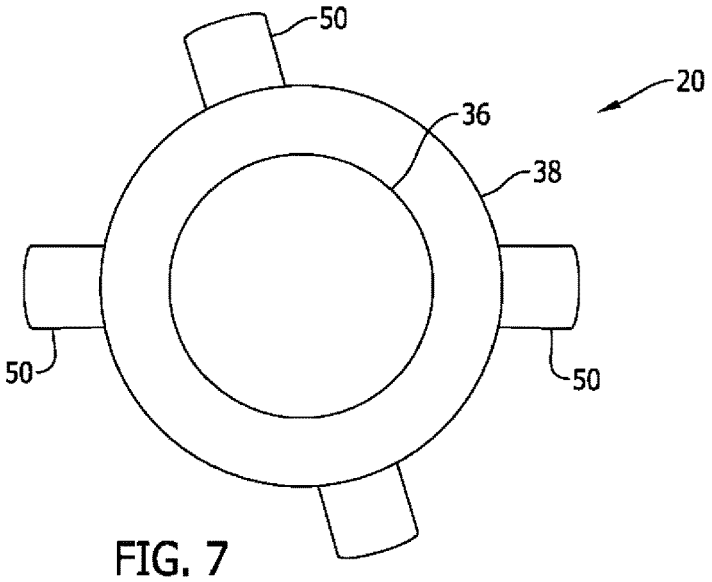
FIG. 7 is a bottom plan of the hub of FIG. 1.
Figure 8:
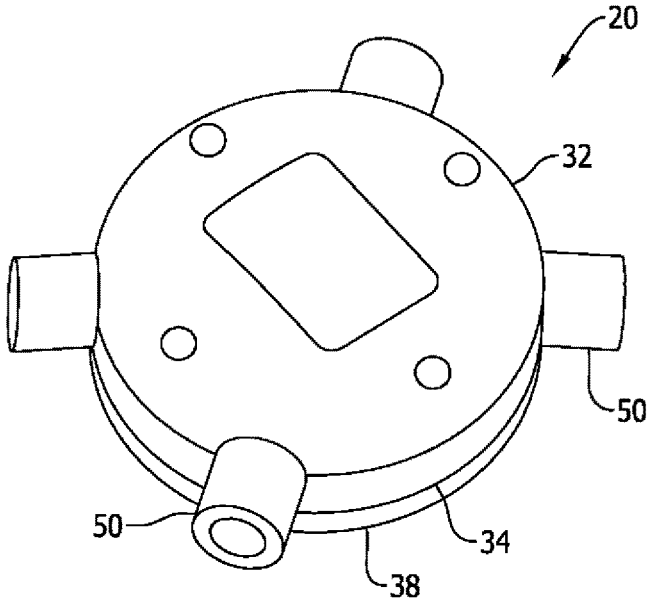
FIG. 8 is a top down perspective of the hub of FIG. 1.
Figure 9:
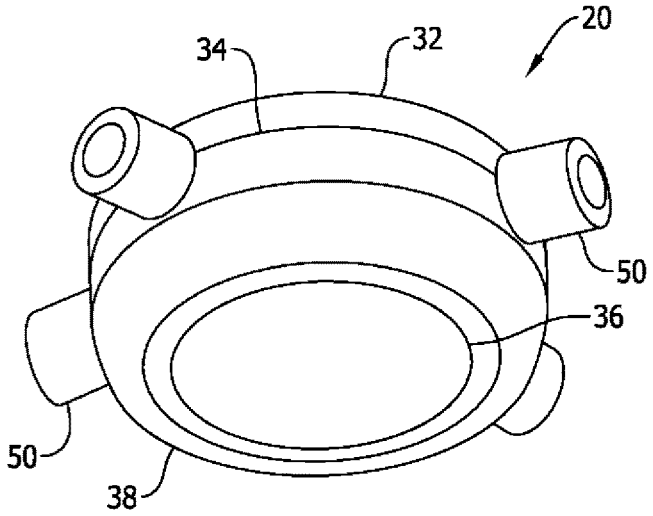
FIG. 9 is a bottom up perspective of the hub of FIG. 1.

Referring to FIGS. 1 and 2, a hub (broadly, a frame joint or frame connector) of a first configuration is designated in its entirety by the reference number 20. The hub 20 joins tent poles (broadly, frame members) 22 to create a frame, generally designated 24 in FIG. 3, for supporting a tent (broadly, a shelter, and more particularly, a shelter skin), generally designated 26 in FIG. 4. The illustrated hub 20 joins four tent poles 22 at a central peak of the tent 26. Those skilled in the art will appreciate hubs configured for joining fewer or more tent poles are envisioned as being within the scope of this description.

As further illustrated in FIGS. 1 and 2, the hub 20 includes a housing 30 consisting of an upper body 32, a central body 34, and a lower body formed from a transparent cover or lens 36 and a bezel 38. A flange 40 provided at an outside edge of the cover 36 engages a step 42 provided at an inside edge of the bezel 38 to center the transparent cover in the bezel. The central body 34 includes a cylindrical rim 44 surrounding a bulkhead or wall 46. Cylindrical socket receivers (broadly, connectors) 50 are formed in the bulkhead 46 for receiving corresponding ends of the tent poles (not shown). The receivers 50 extend radially from a center of the central body 34. In the illustrated configuration, the receivers are spaced by alternating shorter and longer arcs. Those skilled in the art will appreciate other spacings are envisioned as being within the scope of this description. Further, the receivers 50 curve downward to correspond with a shape that the tent poles take when assembled but could be straight and level in some configurations. Although the illustrated receivers 50 are cylindrical sleeves, those skilled in the art will appreciate other connector types (e.g., bayonet or screw connectors) are envisioned as being within the scope of this description. As the illustrated receivers 50 and envisioned receivers are conventional and well understood, they are not described in further detail. The upper body 32 includes openings or recesses 62 corresponding with the receivers 50, and countersunk holes 64 are spaced between the openings for receiving conventional screw fasteners (not shown). The fasteners extend through openings 66 provided in the bulkhead 46 of the central body 34 to corresponding bosses 68 formed in the bezel 38 to hold the housing parts together as a unit. Interengaging flanges or rabbets are provided around the rims of the upper body 32, central body 34, and bezel 36 to maintain the concentricity of the housing parts. Gussets and bracing features are provided throughout the interior of the housing 30 to strengthen the housing and support internal components. Plugs (not shown) may be used to cover the fastener heads in a conventional manner. FIGS. 5-9 illustrate an assembled hub 20.

Figure 10:
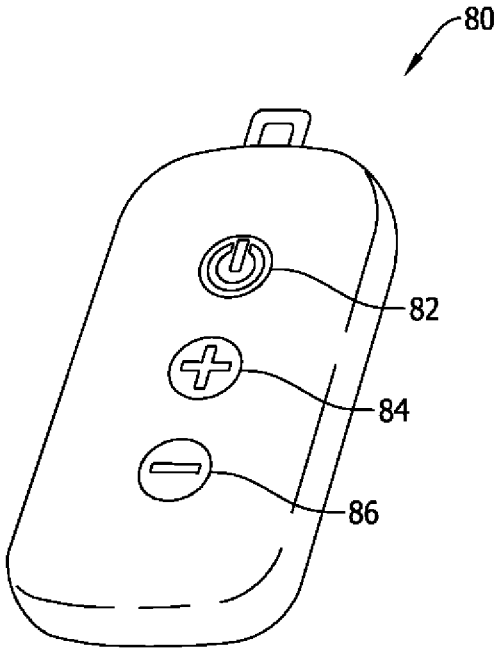
FIG. 10 is a perspective of a control unit for controlling the hub of FIG. 1.

A rechargeable battery (broadly, an electrical source) 70 is positioned inside the housing 30 immediately below the bulkhead 46, and a circuit board, generally designated 72, is positioned above the transparent cover 36. The circuit board 72 includes light emitting diodes (LEDs) (broadly, light emitting elements) 74 arranged in an array on its lower surface to project light through the cover 36. The LEDs 74 are operatively connected to the battery 70 (e.g., via conventional electronic circuitry and wires, not shown) to provide power to the LEDs to illuminate the interior of the tent. A conventional electrical charging connector (e.g., a USB connector) 76 is provided on the circuit board 72, and conventional electronic circuitry and wires operatively connect the charging connector to the battery for recharging the battery using a conventional power cable. Although it is envisioned that a manual switch could be provided for operatively connecting the battery 70 to the LEDs 74 to selectively energize the LEDs, the circuit board 72 of the illustrated configuration includes a receiver (or sensor) and electronic switch. The receiver selectively operates the switch to energize the LEDs 74 in response to an infrared signal (broadly an electromagnetic signal). As shown in FIG. 10, a separate control unit, generally designated 80, is provided for remotely operating the hub 20. In the illustrated configuration, the control unit 80 includes a keypad having an on/off button 82 and separate buttons 84, 86 for increasing and decreasing the LED light output, respectively. The internal circuitry of such a control unit 80 including an infrared transmitter and battery is conventional and is not described in further detail.

To prepare for using the hub 20, a user plugs a charger into the electrical connector 76 for sufficient time to charge the battery 70. The hub 20 includes an LED 88 to indicate the battery 70 is charging. In one configuration, the LED 88 changes color to indicate the battery 70 is fully charged. The circuitry required for this LED is conventional and is not described further. Once at a campsite, the user assembles the frame and tent as usual except the user installs the hub 20 in place of a conventional connector. When needed, the user activates the control unit 80 by pressing the on/off button 82, and increases or decreases the LED output using the control buttons 84, 86. It should be noted that the hub 20 used to assemble the tent frame 24 is preferably positioned immediately above a mesh portion of the tent and below a rain fly, so light emitted by the hub is substantially unobstructed to illuminate the interior of the tent in use while remaining hidden from outside and protected from rain.

Figure 11:
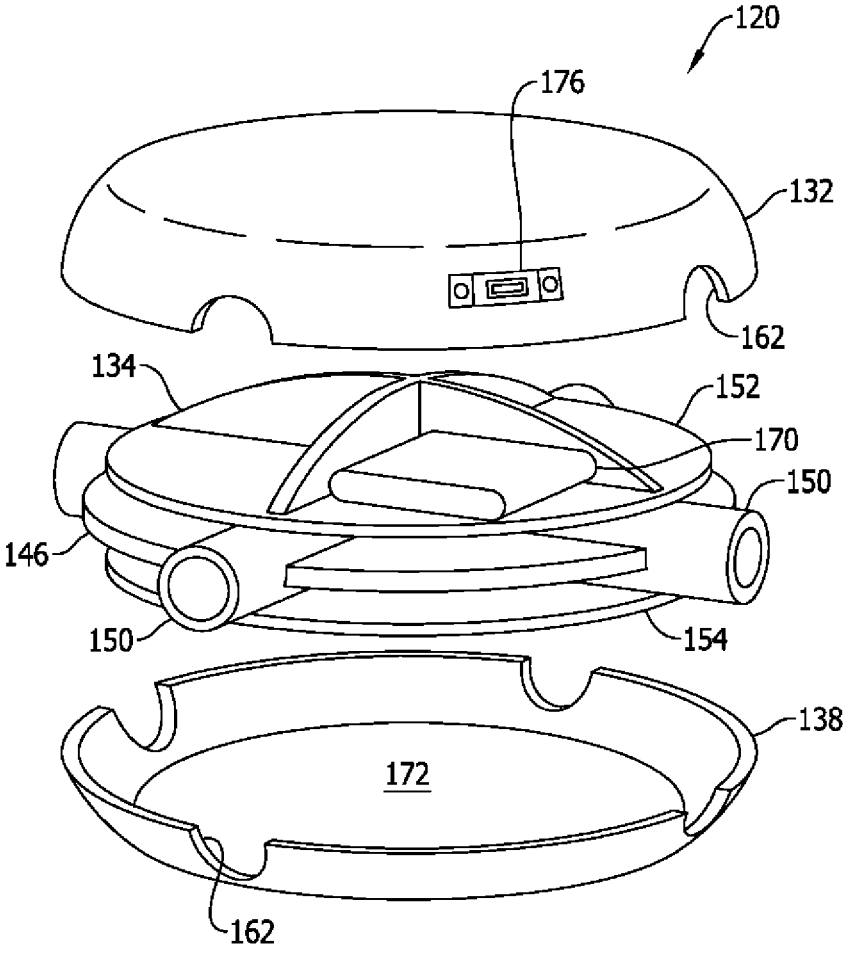
FIG. 11 is a separated top down perspective of a hub of a second configuration.
Figure 12:
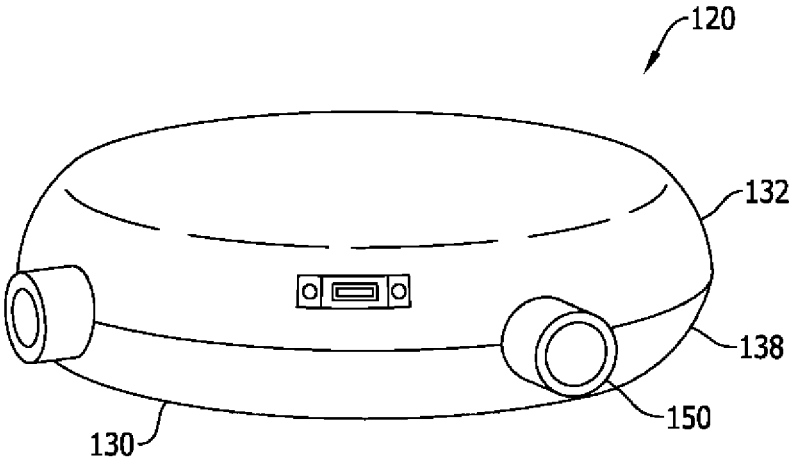
FIG. 12 an assembled top down perspective of the hub of FIG. 11.
Figure 13:
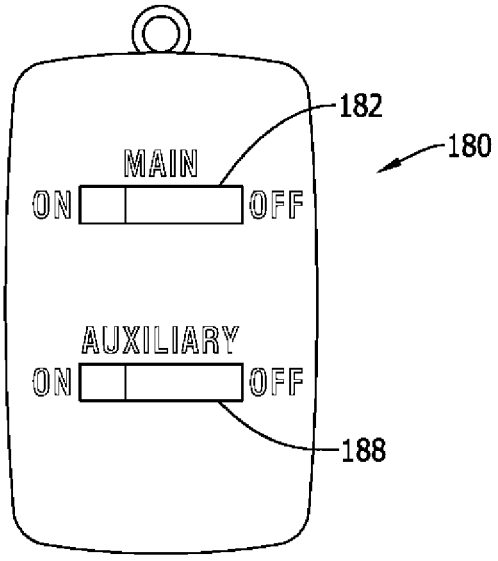
FIG. 13 is front elevation of a control unit for controlling the hub of FIG. 11.

FIG. 11 shows a hub of a second configuration designated in its entirety by the reference number 120. This configuration is similar to the first configuration, and similar elements have similar reference numbers incremented by 100. The hub 120 of the second configuration includes a housing 130 consisting of an upper body 132, a central body 134, and a lower body formed from a bezel 138 and a transparent cover (not shown). The central body 134 includes a central bulkhead or wall 146 supporting cylindrical socket receivers 150. The receivers 150 extend radially from the bulkhead 146 and are equally spaced. Plates 152, 154 are spaced above and below the bulkhead 146. Each plate 152, 154 includes stiffening ribs 156. Both the upper body 132 and lower body 136 include openings or recesses 162 for receiving the receivers 150 during assembly as shown in FIG. 12. A rechargeable battery 170 is positioned inside the housing 130 immediately above the upper plate 152, and a circuit board 172 is positioned between the lower plate 154 and the transparent cover (not shown). As in the prior configuration, the circuit board 172 includes LEDs (not shown) arranged in an array on its lower surface. The LEDs are operatively connected to the battery 170 to power the LEDs. A conventional electrical charging connector (e.g., a USB connector) 176 is mounted on the upper body 132, and conventional electronic circuitry and wires operatively connect the charging connector to the battery for recharging the battery using a conventional power cable. The circuit board 172 has a receiver (or sensor) and electronic switch. The receiver selectively operates the switch to energize the LEDs in response to an infrared signal. As shown in FIG. 13, a separate control unit, generally designated 180, is provided for remotely operating the hub 120. In the illustrated configuration, the control unit 180 includes a keypad having a primary on/off button 182 and a secondary on/off button 188. The primary on/off button 182 powers a first portion of LEDs in the array on the circuit board 172, and the secondary on/off button 188 powers a second portion of LEDs in the array to provide additional light when desired. The hub 120 of the second configuration is operated similarly to the hub 20 of the first configuration.

Figure 14:
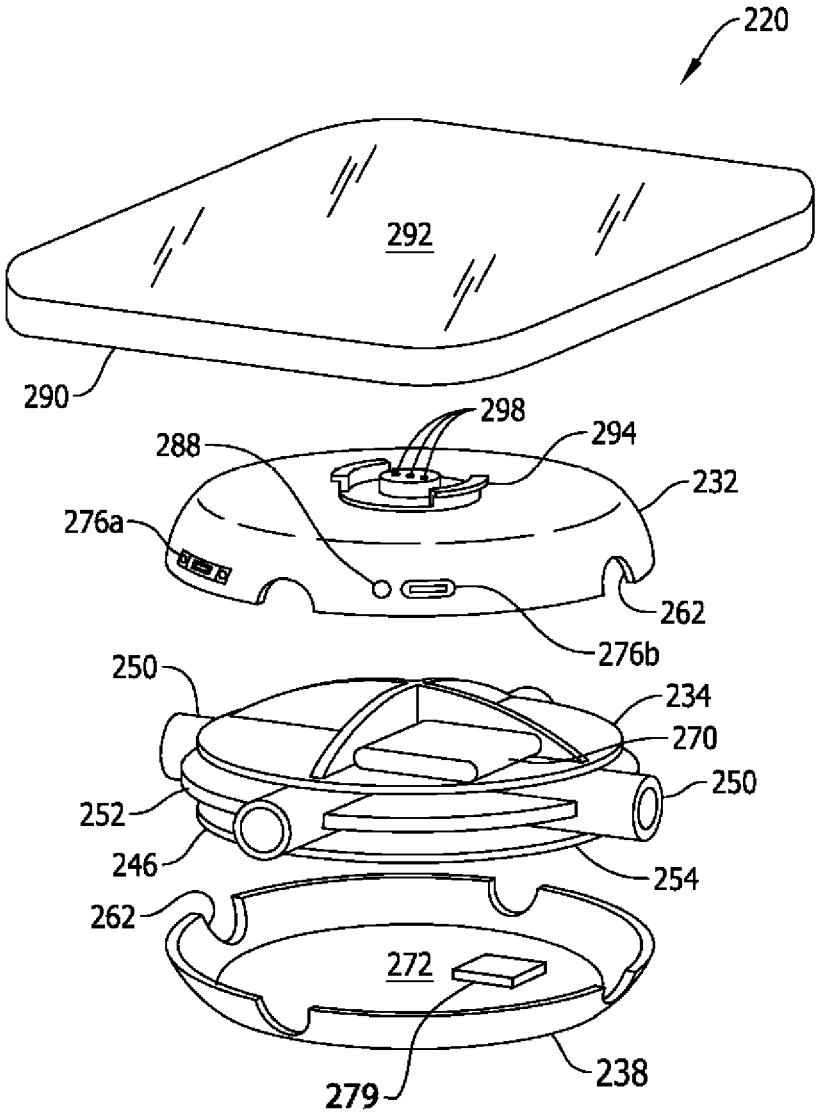
FIG. 14 is a separated top down perspective of a hub of a third configuration.
Figure 15:
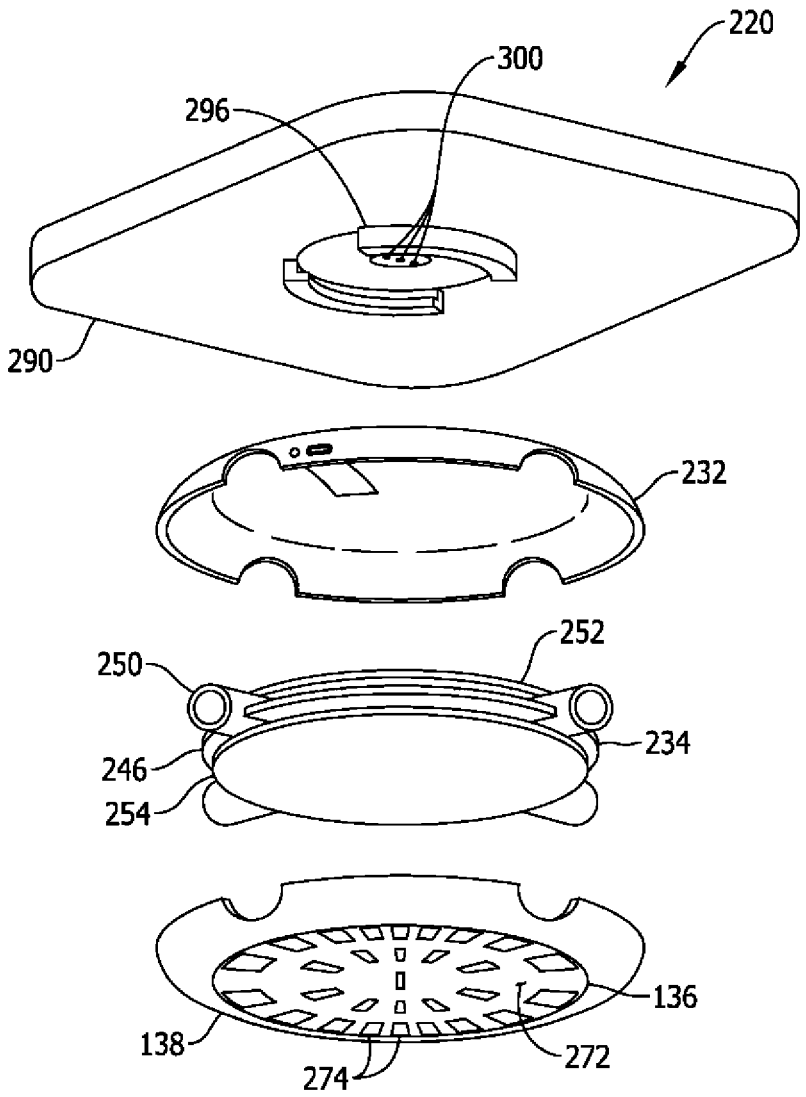
FIG. 15 is a separated bottom up perspective of the hub of FIG. 14.

A hub of a third configuration, generally designated by 220, is illustrated in FIGS. 14 and 15. Many components of the third configuration are similar to the second configuration and identified using similar reference numbers incremented by 100. The hub 220 of the third configuration has a housing 230 consisting an upper body 232, a central body 234, and a lower body comprising a transparent cover 236 and a bezel 238. The central body 234 includes a central bulkhead or wall 246 and plates 252, 254 supporting equally-spaced cylindrical socket receivers 250. The upper and lower bodies 232, 236 have openings 262 for receiving the receivers 250 during assembly. A rechargeable battery 270 is housed in the housing 232 immediately above the upper plate 252, and a circuit board 272 is housed below the lower plate 254. Like the prior configurations, the circuit board 272 includes LEDs (not shown) arranged in an array on its lower surface. The LEDs are operatively connected to the battery 270 to power the LEDs. Two different types of electrical charging connectors (e.g., a standard USB connector and a micro USB connector) 276*a*, 276*b* are mounted in the upper body 232, and conventional electronic circuitry and wires operatively connect the charging connector to the battery 270 for recharging the battery using either type of conventional power cable. The circuit board 272 has a receiver and electronic switch, collectively 279, controlled by an infrared signal transmitted by a remote control (not shown) as previously described. Although the receiver and electronic switch 279 is illustrated schematically as a unitary element in FIG. 14, those skilled in the art will appreciate the receiver and switch may be separate units.

Figure 16:
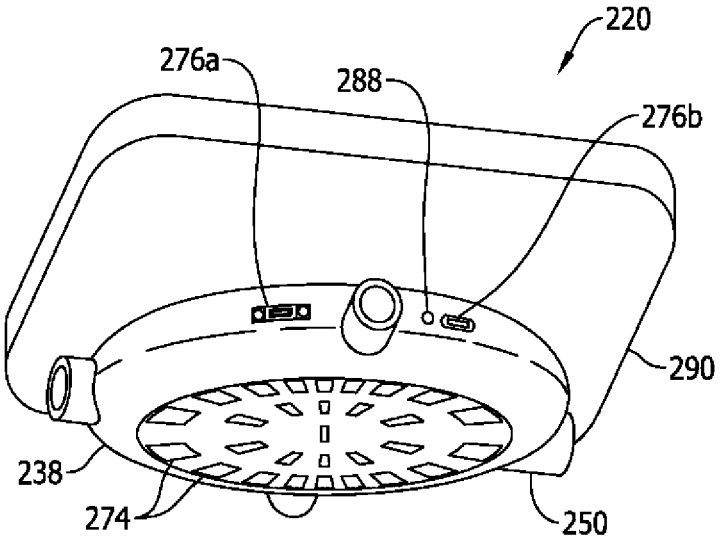
FIG. 16 an assembled bottom up perspective of the hub of FIG. 14.
Figure 17:
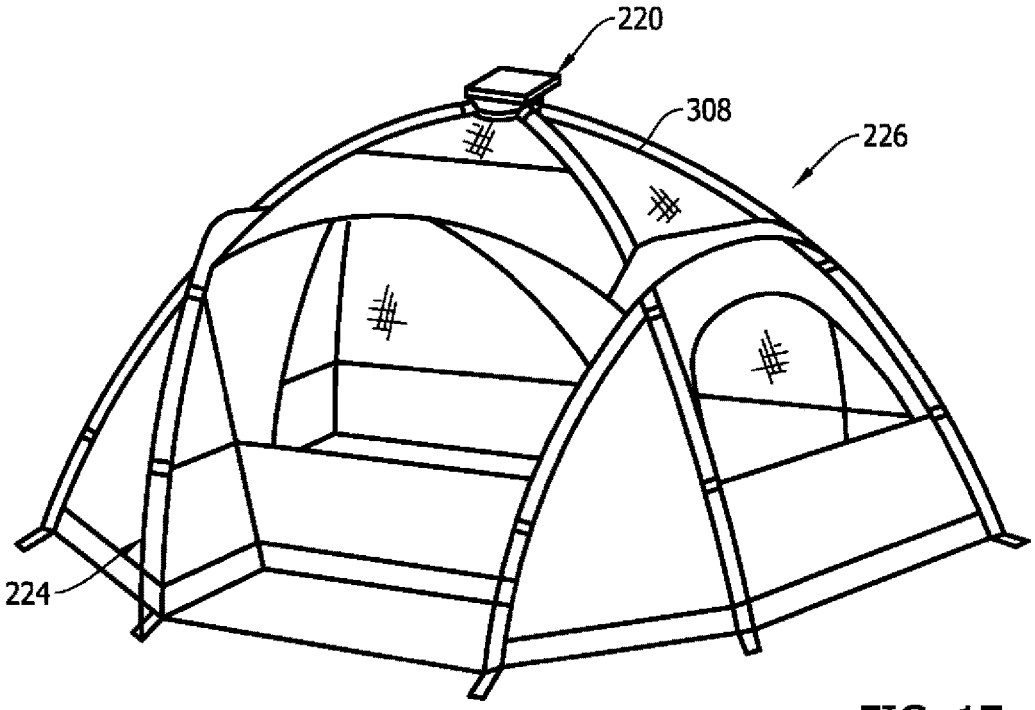
FIG. 17 is a perspective of a frame assembled with the hub of FIG. 14.
Figure 18:
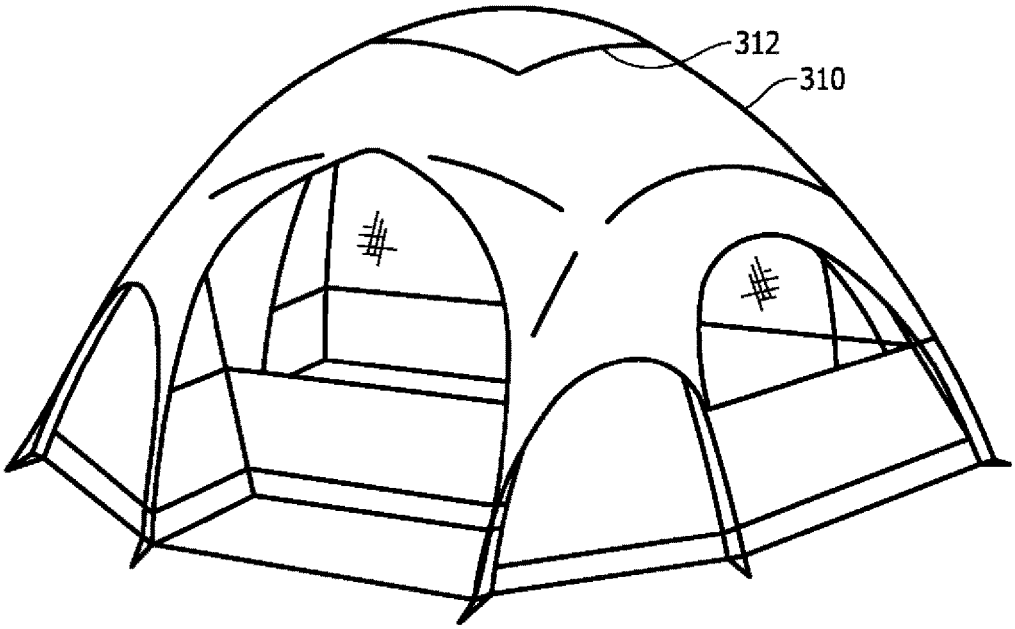
FIG. 18 is a perspective of a tent assembled with the hub of FIG. 14.

In addition to the first housing 230 described above, the hub 220 of the third configuration includes a second housing 290 supporting a solar cell 292. The first and second housings 230, 290 include interengageable bayonet connectors (broadly, mounting or connecting elements) 294, 296 for selectively connecting the first and second housings. Those skilled in the art will appreciate that other types of connectors could be used without departing from the scope of this disclosure. As further illustrated in FIGS. 14 and 15, each bayonet connector 294, 296 includes a group of electrical contacts (broadly, electrical connectors) 298, 300, respectively. The electrical contacts 298, 300 are configured and oriented such that they are aligned and in contact when the bayonet connectors 294, 296 are interengaged so as to connect the first and second housings 230, 290. The first electrical contact group 298 is operatively connected to the battery 270, and the second electrical contact group 300 is operatively connected to the solar cell 292. Accordingly, when the bayonet connectors 294, 296 on the first and second housings 230, 290 are interengaged so the electrical contacts 298, 300 are in contact as shown in FIG. 16, the solar cell 292 is operatively connected to the battery 270 for recharging the battery. As in the prior configurations, the hub 220 is used to assemble the tent frame 24 as shown in FIG. 17. Preferably, the hub 220 is positioned immediately above a mesh portion of the tent 26, so the LEDs of the hub are substantially unobstructed and can fully illuminate the interior of the tent. As illustrated in FIG. 18, a rain fly 310 overlays the tent 26. The rain fly 310 includes a transparent or translucent panel 312 that permits light through the rain fly to energize the solar cell 292. It is envisioned that a bright white polyester tent fabric will have sufficient transmissivity to allow solar energy through the rain fly 310 to energize the solar cell 292 and charge the battery.

Figure 19:
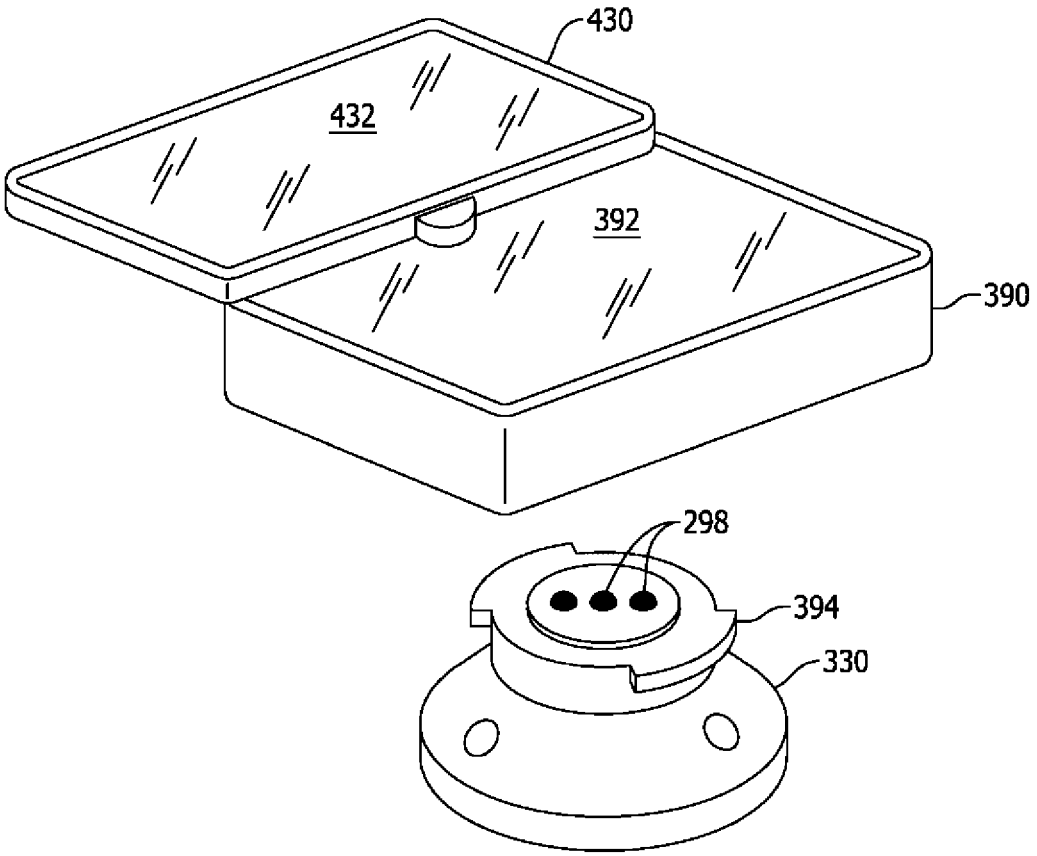
FIG. 19 is a top down perspective of a hub of a fourth configuration having its first and second housing separated.
Figure 20:
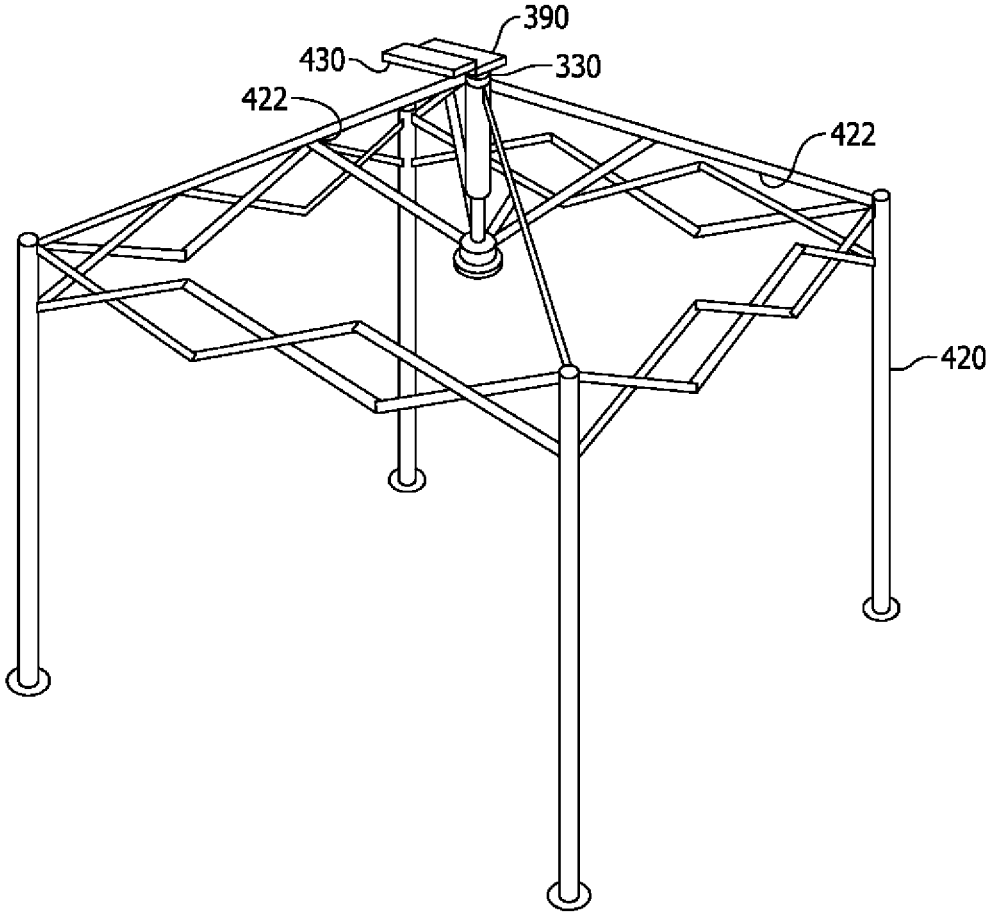
FIG. 20 is a perspective of a canopy shelter frame assembled with the hub of FIG. 19.

FIG. 19 illustrates a first and second housing 330, 390, respectively of a fourth configuration. The first housing 330 includes a bayonet connector 394 adapted to mount the second housing 390 on the first. Electrical contacts 298 are provided on the bayonet connectors of the first and second housing 330, 390 as in the third configuration. Rather than including LEDs like prior configurations, the first housing 330 of the fourth configuration is fixedly secured to a canopy frame 420 as shown in FIG. 20 and operatively connected to LEDs 422 mounted on the frame using a conventional means. The second housing 390 includes a plate or support 430 pivotally or rotatably attached to the housing. A first solar cell 392 is mounted on the second housing 390 and a second or auxiliary solar cell 432 is mounted on the plate 430. Both the first and second solar cells 392, 432 are operatively connected to the electrical contacts on the second housing 390. The plate 430 of the illustrated configuration pivots relative to the second housing 390 about an axis extending normal to the solar cells 392, 432 so the plate moves between a deployed position as shown and a stowed position, in which the plate overlies the solar cell 392 on the second housing 390 for storage. Other features and aspects of this configuration will be evident to those skilled in the art.

Figure 21:
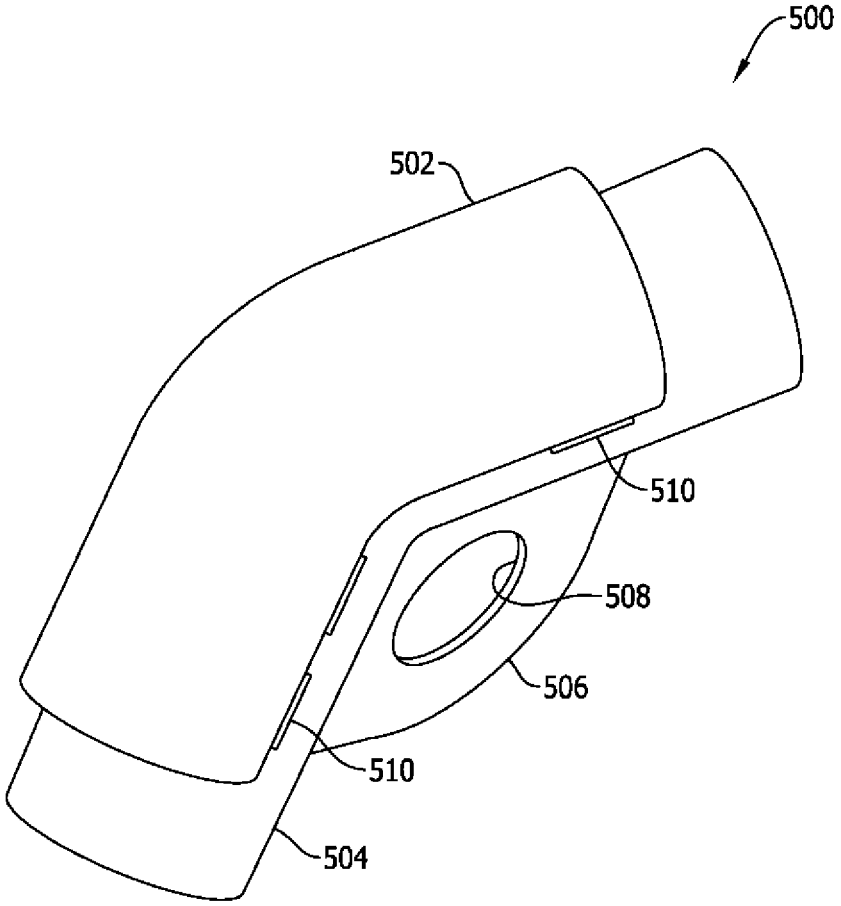
FIG. 21 is a top down perspective of a hub of a fifth configuration.
Figure 22:
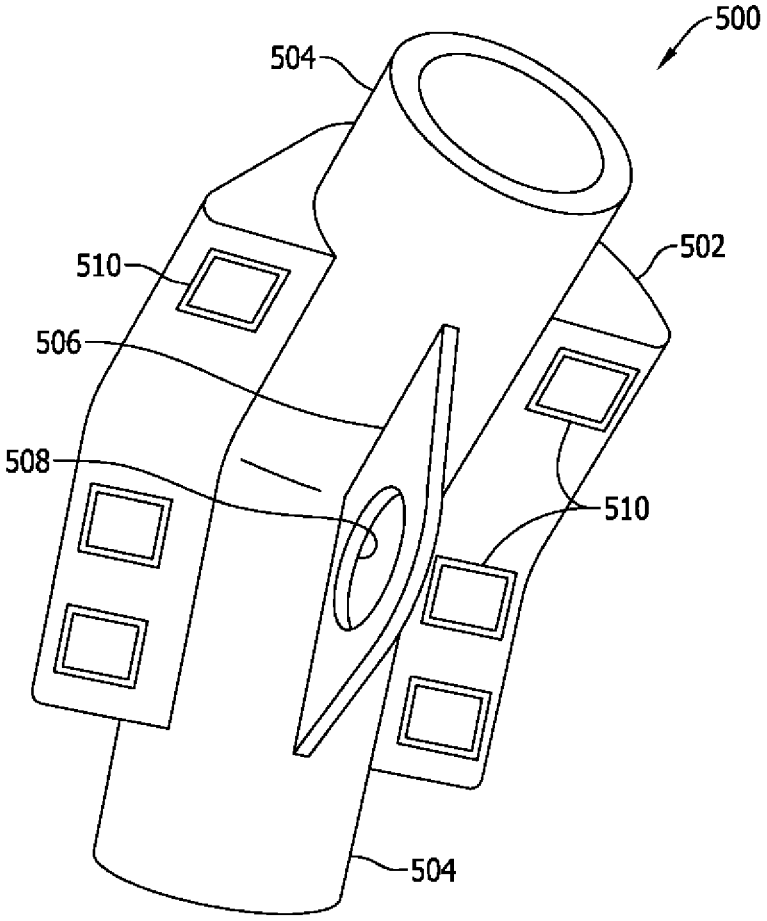
FIG. 22 is a bottom up perspective of the hub of FIG. 21.
Figure 23:
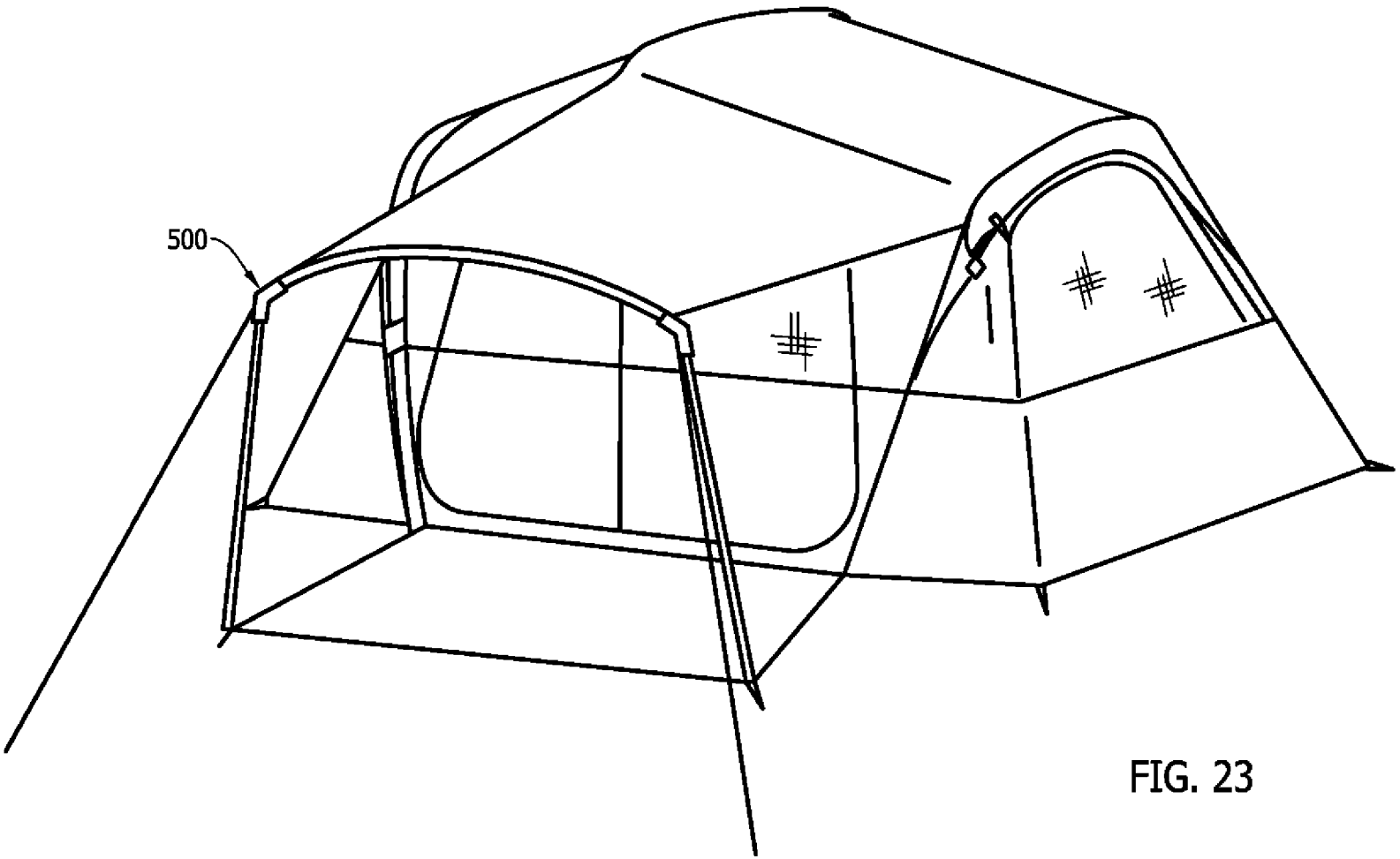
FIG. 23 is a perspective of a tent assembled with the hub of FIG. 21.

FIGS. 21 and 22 illustrate a hub 500 of a fifth configuration for connecting to elongate frame members at oblique angles such as shown in FIG. 23. The hub 500 includes a housing or body 502 having two cylindrical socket receivers 504 extending outward from the body. A flange 506 provided adjacent the receivers 504 includes an opening 508 for attaching a portion of a tent to the hub 500. The body 502 houses a battery and circuitry (not shown) similar to that described previously. LEDs 510 are provided on the body 502 illuminating an area surrounding the hub 500. The hub 500 may include provisions for replacing and charging a battery (not shown) housed in the housing 502. As other features of the hub 500 of the fifth embodiment are apparent to those skilled in the art, they are not described.

As will be appreciated by those skilled in the art, the hubs described above are integral with and essential for constructing the corresponding shelter frames. Because the description describes the drawings in detail, it will be apparent that modifications and variations are well within the abilities of those skilled in the art. Further, the manufacture and use of the components and assemblies described above are well within the abilities of those of ordinary skill in the art and are not described in further detail.

When introducing elements of the present invention or the described configuration(s) thereof, the articles "a," "an," "the," and "said" are intended to mean that there are one or more of the elements. The terms "comprising," "including," and "having" are intended to be inclusive and mean that there may be additional elements other than the listed elements.

As various changes can be made in the above constructions, products, and methods without departing from the scope of the invention, it is intended that all matter contained in the above description and shown in the accompanying drawings shall be interpreted as illustrative and not in a limiting sense.

What is claimed is:

1. A frame joint for connecting a plurality of elongate frame members adapted to support a flexible shelter skin for selectively erecting a shelter, said frame joint comprising:

a first housing having an exterior wall defining a hollow interior and a plurality of frame connectors, each frame connector extending from the exterior wall of said first housing opposite the hollow interior and being adapted to releasably connect said first housing to an elongate frame member of said plurality of elongate frame members permitting said first housing to be connected simultaneously to at least two elongate frame members of said plurality of frame members;

an electrical source mounted within the hollow interior of the first housing;

a light emitting element mounted on the first housing and connected to the electrical source for emitting light to illuminate an interior of the shelter, said light emitting element being positioned on the first housing to direct light toward the interior of the shelter when the first housing is connected to said at least two elongate frame members of said plurality of elongate frame members and the plurality of elongate frame members are supporting said flexible shelter skin; and a switch operatively connected to the electrical source and the light emitting element for selectively energizing the light emitting element.

2. A frame joint as recited in claim 1, wherein each frame connector of said plurality of frame connectors comprises a socket for receiving an end of an elongate frame member of said plurality of elongate frame members.

3. A frame joint as recited in claim 1 in combination with said plurality of elongate frame members.

4. A frame joint as recited in claim 3 in combination with said flexible shelter skin.

5. A frame joint as recited in claim 1 wherein the electrical source comprises a battery adapted to store an electrical charge.

6. A frame joint as recited in claim 5, wherein:

the battery comprises a rechargeable battery; and the frame joint further comprises an electrical connector for selectively connecting a power source to the battery for recharging the battery.

7. A frame joint as recited in claim 5, wherein:

the battery comprises a rechargeable battery; and the frame joint further comprises a first solar cell operatively connected to the rechargeable battery for recharging the battery.

8. A frame joint as recited in claim 7, wherein:

the first housing includes:

a first mounting element; and a first electrical connector operatively connected to the rechargeable battery; and the frame joint further comprises a second housing including:

a second mounting element configured for releasable attachment to the first mounting element to releasably attach the second housing to the first housing; and a second electrical connector configured for releasable connection to the first electrical connector; and wherein the solar cell is mounted on the second housing operatively connected to the second electrical connector, so the solar cell is operatively connected to the rechargeable battery when the second electrical connector is connected to the first electrical connector.

9. A frame joint as recited in claim 8, wherein:

the first electrical connector is positioned on the first mounting element;

the second electrical connector is positioned on the second mounting element; and the first electrical connector and the second electrical connector are electrically connected when the first mounting element is connected to the second mounting element.

10. A frame joint as recited in claim 9, wherein:

the first mounting element and the second mounting element constitute a bayonet connector;

the first electrical connector constitutes a plurality of contacts on the first mounting element;

the second electrical connector constitutes a plurality of contacts on the second mounting element; and the plurality of contacts on the first mounting element contact the plurality of contacts on the second mounting element when the first mounting element is connected to the second mounting element.

11. A frame joint as recited in claim 8, further comprising:

a plate mounted on the second housing; and an auxiliary solar cell mounted on the plate operatively connected to the second electrical connector, so the auxiliary solar cell is operatively connected to the rechargeable battery when the second electrical connector is connected to the first electrical connector.

12. A frame joint as recited in claim 11, wherein the plate is pivotally mounted on the second housing to selectively space the auxiliary solar cell from the second housing.

13. A frame joint as recited in claim 1, wherein the first housing is configured as a central hub for connecting said plurality of elongate frame members at a peak of a tent.

14. A frame joint as recited in claim 1, wherein the first housing is configured as a frame connector for connecting a first elongate frame member of said plurality of elongate frame members to a second elongate frame member of said plurality of elongate frame members at a position spaced from a central hub of a tent.

15. A frame joint as recited in claim 14, wherein the frame connector is configured for connecting said first elongate frame member to said second elongate frame member so the second elongate frame member extends at an oblique angle relative to the first elongate frame member.

16. A frame joint as set forth in claim 1, further comprising a sensor connected to the switch for selectively operating the switch to energize the light emitting element in response to an electromagnetic signal.

17. A frame joint as set forth in claim 16, wherein the sensor is an infrared sensor adapted to selectively operate the switch to energize the light emitting element in response to an infrared electromagnetic signal.

18. A frame joint as set forth in claim 17 in combination with an infrared transmitter adapted to signal the infrared sensor to selectively operate the switch to energize the light emitting element.

19. A frame joint for connecting a plurality of elongate frame members adapted to support a flexible shelter skin for selectively erecting a shelter, said frame joint comprising:

a housing having a hollow interior, a first frame connector configured for releasably connecting a first elongate frame member of said plurality of elongate frame members to the housing and holding the first elongate frame member in a fixed position relative to the housing, and a second frame connector configured for releasably connecting a second elongate frame member of said plurality of elongate frame members to the housing and holding the second elongate frame member in a fixed position relative to the housing so the second elongate frame member extends at an oblique angle relative to the first elongate frame member;

a battery adapted for storing an electrical charge mounted in the interior of the housing;

a light emitting element mounted on the housing and connected to the battery for emitting light to illuminate an interior of the shelter, said light emitting element being positioned on the housing to direct light toward the interior of the shelter when the housing is connected to said first and second elongate frame members; and a switch operatively connected between the battery and the light emitting element for selectively energizing the light emitting element.

20. A frame joint as recited in claim 19, wherein the first frame connector and the second frame connector each comprises a socket for receiving an end of an elongate frame member of said plurality of elongate frame members.

21. A frame joint as recited in claim 19, wherein:

the battery comprises a rechargeable battery; and the frame joint further comprises an electrical connector operatively connected to the rechargeable battery for selectively connecting a power source to the rechargeable battery for recharging the battery.

22. A frame joint for connecting a plurality of elongate frame members adapted to support a flexible shelter skin, said frame joint comprising:

a first housing having an interior and a plurality of frame connectors, a first frame connector of said plurality of frame connectors being adapted to releasably connect a first elongate frame member of said plurality of elongate frame members to said first housing and hold the first elongate frame member in a fixed position relative to said first housing, and a second frame connector of said plurality of elongate frame connectors being adapted to releasably connect a second elongate frame member of said plurality of elongate frame members to said first housing and hold the second elongate frame member in a fixed position relative to said first housing;

a battery adapted for storing an electrical charge mounted in the interior of the first housing;

a light emitting element mounted on the first housing and connected to the battery for emitting light to illuminate an interior of a shelter, said light emitting element being positioned on the first housing to direct light toward the interior of the shelter when the joint is connected to said first and second elongate frame members of said plurality of elongate frame members and the plurality of elongate frame members are supporting said flexible shelter skin; and a switch operatively connected to the electrical source and the light emitting element for selectively energizing the light emitting element.

23. A frame joint as recited in claim 22, wherein:

the battery comprises a rechargeable battery; and the frame joint further comprises a first solar cell operatively connected to the rechargeable battery for recharging the battery.

24. A frame joint as recited in claim 23, further comprising an electrical connector for selectively connecting a power source to the battery for recharging the battery.

25. A frame joint as recited in claim 23, wherein the first housing includes:

a first mounting element; and a first electrical connector operatively connected to the rechargeable battery; and the frame joint further comprises:

a second housing including:

a second mounting element configured for releasable attachment to the first mounting element to releasably attach the second housing to the first housing; and a second electrical connector configured for releasable connection to the first electrical connector; and a solar cell mounted on the second housing operatively connected to the second electrical connector, so the solar cell is operatively connected to the rechargeable battery when the second electrical connector is connected to the first electrical connector.

26. A frame joint as recited in claim 25, wherein:

the first electrical connector is positioned on the first mounting element;

the second electrical connector is positioned on the second mounting element; and the first electrical connector and the second electrical connector are electrically connected when the first mounting element is connected to the second mounting element.

27. A frame joint as recited in claim 26, wherein:

the first mounting element and the second mounting element constitute a bayonet connector;

the first electrical connector constitutes a plurality of contacts on the first mounting element;

the second electrical connector constitutes a plurality of contacts on the second mounting element; and the plurality of contacts on the first mounting element contact the plurality of contacts on the second mounting element when the first mounting element is connected to the second mounting element.

28. A frame joint as recited in claim 25, further comprising:

a plate mounted on the second housing; and an auxiliary solar cell mounted on the plate operatively connected to the second electrical connector, so the auxiliary solar cell is operatively connected to the rechargeable battery when the second electrical connector is connected to the first electrical connector.

29. A frame joint as recited in claim 28, wherein the plate is pivotally mounted on the second housing to selectively space the auxiliary solar cell from the second housing.

* * * * *